United States Patent [19]

Olson

[11] 4,281,309

[45] Jul. 28, 1981

[54] THERMALLY ACTUATED CUT-OFF LINK OR SWITCH AND METHOD OF MAKING THE SAME

[76] Inventor: Harry W. Olson, 3124 - 63rd St., Woodridge, Ill. 60515

[21] Appl. No.: 25,949

[22] Filed: Apr. 2, 1979

Related U.S. Application Data

[63] Continuation-in-part of Ser. No. 891,020, Mar. 28, 1978, abandoned.

[51] Int. Cl.[3] ..... H01H 37/76

[52] U.S. Cl. ..... 337/409; 29/623

[58] Field of Search ..... 337/409, 408, 407, 403, 337/402, 401; 29/623

[56] References Cited

U.S. PATENT DOCUMENTS

| | | | |
|---|---|---|---|
| 3,930,215 | 12/1975 | Senor | 337/409 |
| 3,944,960 | 3/1976 | Audette et al. | 337/409 |
| 4,025,889 | 5/1977 | Schwarz | 337/409 |
| 4,065,741 | 12/1977 | Sakamoto et al. | 337/409 |
| 4,075,596 | 2/1978 | Plasko | 337/409 |
| 4,109,229 | 8/1978 | Plasko | 337/409 |

*Primary Examiner*—Harold Broome

[57] ABSTRACT

An ambient thermally actuated switch comprises a power lead extending longitudinally into and insulated from one end of a metal casing. The power lead made of a soft low resistance material like copper is bifurcated at its inner end to form outwardly inclining arms which, in a normally closed embodiment of the switch, makes contact with the inner surface of the casing. The arms are pressed against an insulating backing member so that the arms expand outwardly into a low resistance contact with the casing. The backing member forms part of a spring-urged, longitudinally extending, sandwich of elements extending between the ends of the casing and preferably comprising a pellet of meltable material, a first partially compressed spring, said backing member, arm-deforming means positioned contiguous to and adapted to collapse said arms when released to do so, and a second fully compressed spring applying a force acting on said deforming means to force it into an arm-collapsing position when the pellet melts. In assembling the switch, the bifurcated power lead is pushed against the backing member with a force which provides a desired measure low resistance and the power lead is anchored in this adjusted position.

30 Claims, 25 Drawing Figures

FIG.1
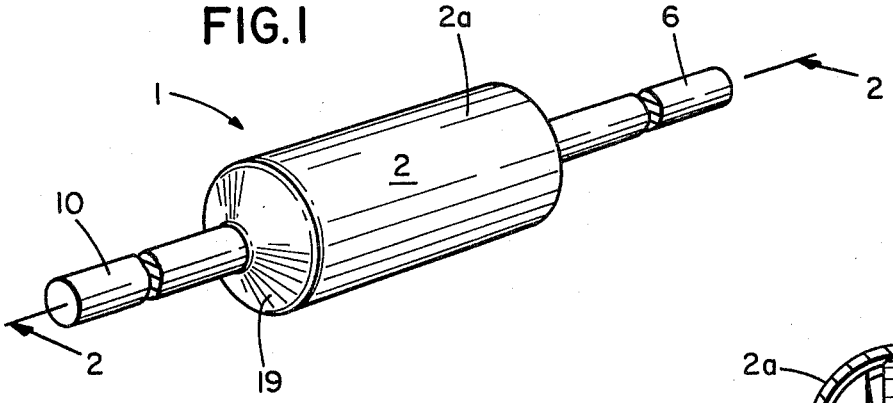
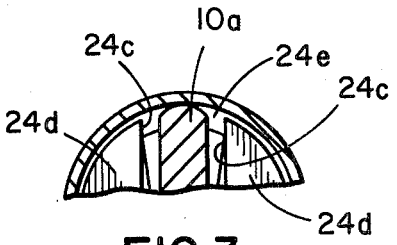
FIG.3
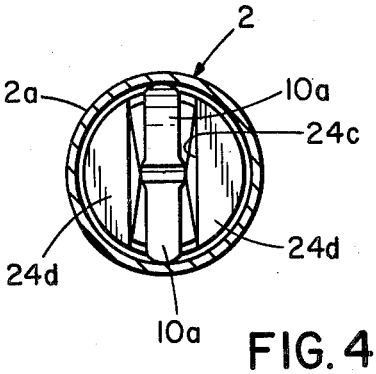
FIG.4
FIG.2
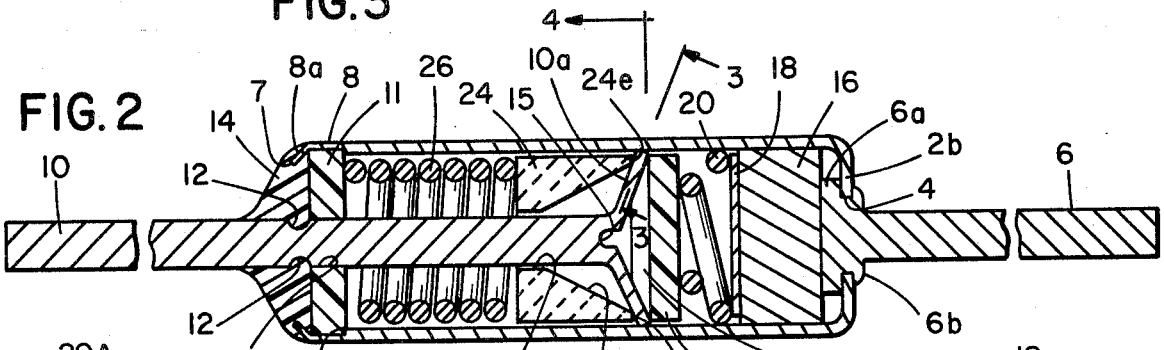
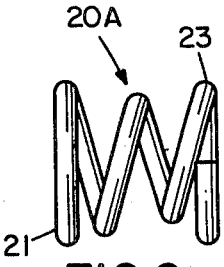
FIG.6
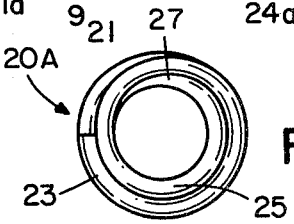
FIG.7
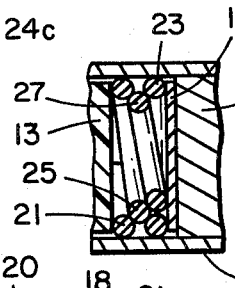
FIG.8
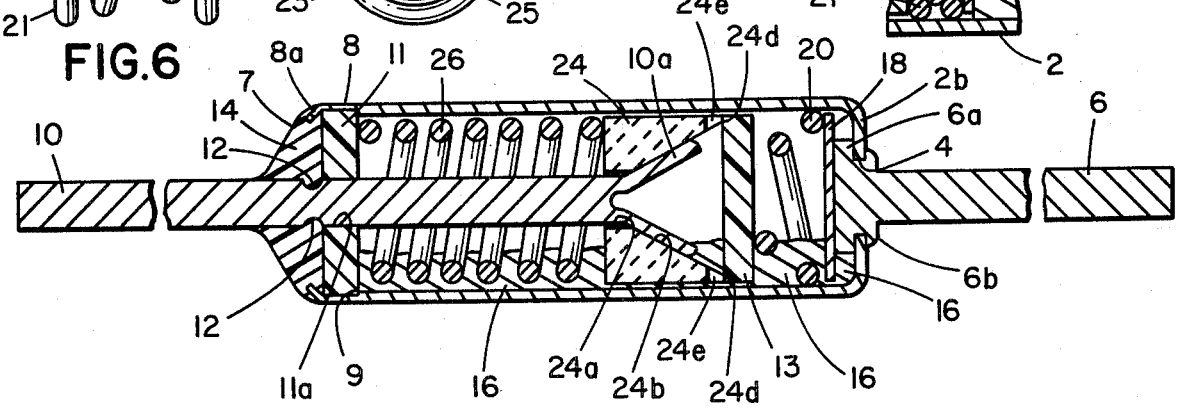
FIG.5

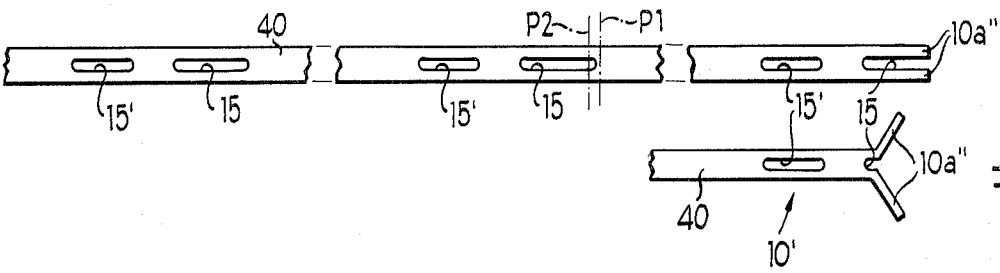
Fig 20
Fig 21
Fig 22
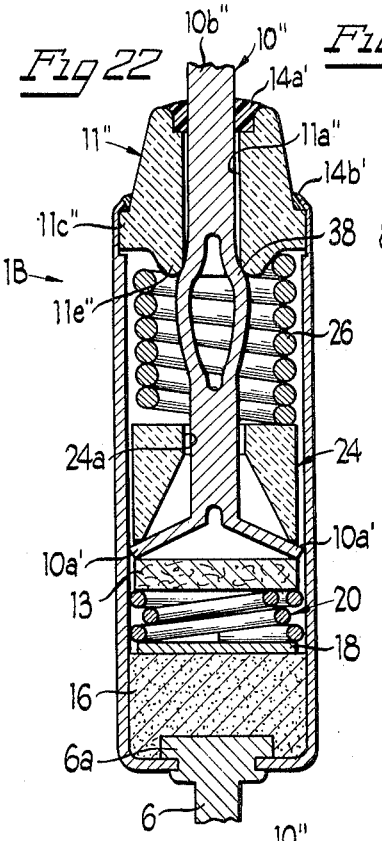
Fig 23
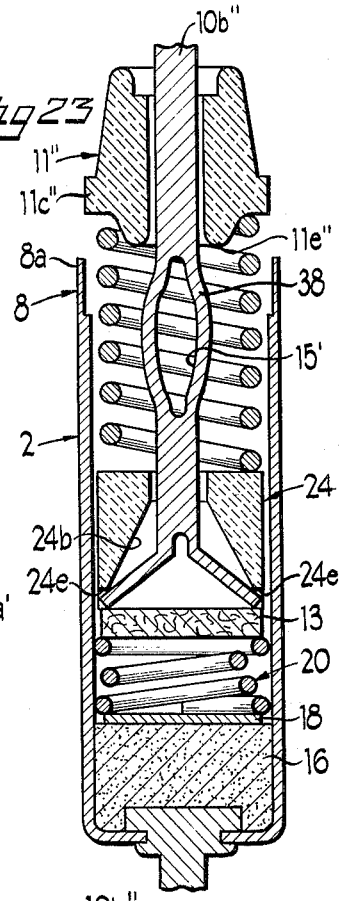
Fig 24
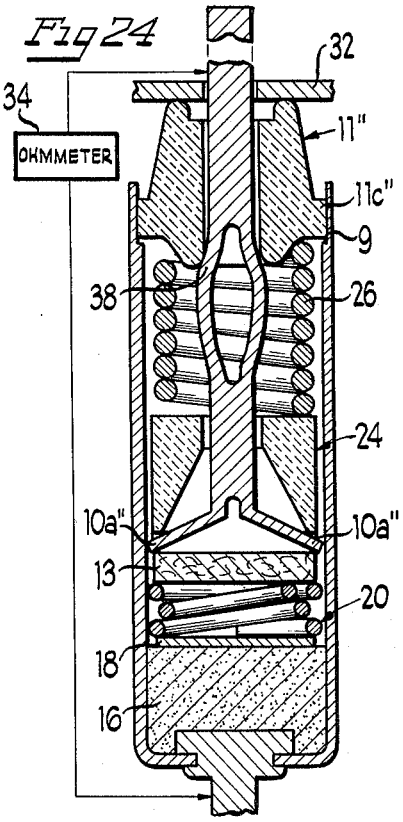
Fig 25
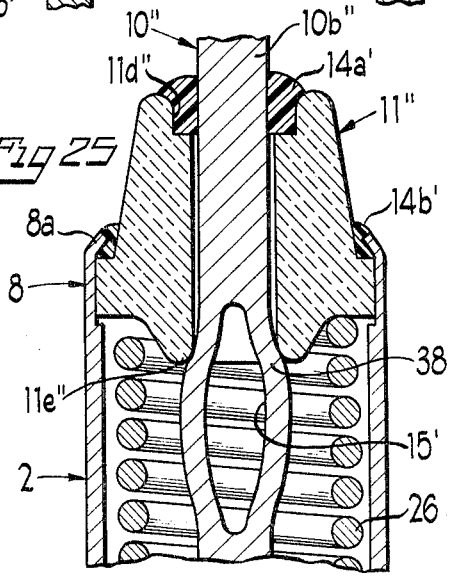

THERMALLY ACTUATED CUT-OFF LINK OR SWITCH AND METHOD OF MAKING THE SAME

RELATED APPLICATION

This application is a continuation-in-part of application Ser. No. 891,020, filed Mar. 28, 1978, now abandoned.

BACKGROUND OF THE INVENTION

This invention relates to thermally actuated cut-off links (also referred to commonly as thermal fuses or cut-offs) and normally open switches of a type which responds to the ambient temperature when it reaches a given value. Normally closed versions of such thermally actuated cut-off links, for examples, are frequently physically incorporated into the windings of electric motors and in other devices requiring thermal protection and electrically connected in series with such devices so that the cut-off link will de-energize the device involved when the ambient temperature exceeds a given safe value.

Ambient thermally actuated cut-off links have been manufactured in two different configurations, one of which is disclosed, for example, in U.S. Pat. No. 3,180,958 to P. E. Merrill, and the other of which is disclosed in U.S. Pat. No. 3,944,960 to Audette et al. In both of these types of cut-off links the ambient heat is transmitted to the interior of the link through a generally elongated cylindrically-shaped conductive casing initially substantially closed at one end and open at the other end. A first power lead extends longitudinally into an insulating closure in the open end of the housing and terminates in a flat end making a separable contact interface with a spring metal connector member spring-urged thereagainst and having a plurality of contact-forming arms resiliently pressing against and making sliding contact with the conductive interior walls of the casing. A second power lead extends longitudinally into the closed end of the casing where it is crimped to or otherwise connected to the end wall of the casing to make a permanent inseparable low resistance engagement with the end wall. The interface of the contact-forming arms of the connector and the inside walls of the casing and the interface of the first power lead and the connector form two separable electric contacts between the power leads having a resistance much greater than that between the second power lead and the casing end wall. It is believed that at high rated currents of large electric motors or other devices requiring thermal protection heat develops at these separable contact interfaces which can appreciably affect the ambient temperature at which the link opens, which is lowered thereby.

In the type of thermally actuated cut-off link exemplified by the Merrill patent, the casing contains a sandwich of elements including a pellet of meltable material at the closed end of the casing, a first partially compressed spring, the contact-forming arm carrying connector urged against the end of the power lead passing through the open insulated end of the casing, and a second weaker partially compressed spring on the opposite side of the connector which applies a force to the connector in a direction tending to move the connector away from the power lead. When the pellet melts at the control temperature, the stronger spring expands until its force equals that of the weaker spring, and then the originally weaker spring expands to push the connector away from the end of the adjacent power lead to open the cut-off link.

In the type of ambient thermally actuated cut-off links exemplified in the Audette et al patent, where deformable contacts are separated from an adjacent contact surface by an arm-deforming member (in a manner like that disclosed in an earlier U.S. Pat. No. 3,274,363 to McGirr et al and in a later U.S. Pat. No. 4,109,229 to Plasko), the sandwich of elements within the casing includes only a single partially compressed spring. This spring applies pressure against a meltable pellet, in turn, positioned contiguous to an arm-deforming member which, when the pellet melts, is pushed against the contact-forming arms of the connector to deform the arms inwardly away from the interior of the casing to open the fuse. In the types of cut-off links exemplified by the Merrill, Audette et al, and Plasko links described above, the constructions involved are such that the resistance of the contact interfaces described cannot be adjusted during or after assembly thereof, and differences in the internal resistance of what appear to be identical cut-off links, can cause variations in the ambient temperature at which identical appearing fuses open. Also, the deformable contact of these cut-off links are made of spring metal and the contact resistances between the contact-forming arms and the adjacent contact surfaces are much higher than desired and can increase undesirably with ambient temperature and current generated heat at the contact interface. A premature opening of the cut-off links below the rated temperature due to the creeping of the pellets is also believed to be a particular problem with the Audette et al fuse since such creeping can apply a contact-opening force on the contact-forming arms because of the location of the pellet adjacent to the arms.

An object of my invention is to provide an ambient thermally actuated cut-off link design of the type having a cylindrical casing and contact-forming arms engaging the casing to provide continuity between the power leads of the cut-off link, and which is constructed in a manner where the internal resistance of the cut-off link can be substantially reduced from the heretofore obtained in cut-off links of this type, thereby minimizing the internally generated heat of the link.

Another object of my invention is to provide an ambient thermally actuated cut-off link and a method of making the same where the control temperature thereof can be held closer tolerances, especially with higher currents, than can the thermally actuated cut-off links described above. A related object of the invention is to provide a unique thermally actuated cut-off link and a method of making the same wherein the internal resistance thereof is readily adjusted to a desired low value during assembly of the cut-off link and wherein this adjusted resistance remains at or close to the adjusted value for the life of the cut-off link.

Still another object of the invention is to provide an improved reliable ambient thermally actuated cut-off link or switches which can be mass produced at a relatively low cost.

Another disadvantage of the thermally-actuated cut-off link disclosed in the Audette et al patent is due to the location of the meltable pellet between the arm-deforming member and the connector contact-deforming arms. This causes the unfortunate result that, when the pellet melts, the initial expansion of the spring is used to move the arm-deforming member a distance equal approximately to the initial thickness of the pellet, before the force of the spring is effective in deforming the contact-forming arms, so that the initial greater force of the spring required causes pellet creep rather than opening of the link. A larger spring is thus necessary to produce the force necessary to deform the contact-deforming arms engaging the casing walls which will aggravate the problem of creep. Accordingly, another object of my invention is to provide an ambient thermally actuated cut-off link of the type exemplified by the Audette et al cut-off link wherein an arm-deforming member is placed under spring pressure and upon the melting of the fusible pellet the expansion of the spring which urges the arm-deforming member toward the connector arms is immediately operative to deform the connector arms.

SUMMARY OF THE INVENTION

The present invention utilizes a cut-off link construction of the type wherein, when the link is closed, one and preferably at least two deformable contact-forming arms engage an associated contact surface and the link is opened by deforming the contact-forming arms away from the associated contact surface to open the link, analagous to that disclosed in said McGirr et al patent. The cut-off link is an ambient thermally actuated device, and so it is designed efficiently to receive ambient heat in the manner, for example, exemplified by the cut-off link disclosed in said Merrill patent, where contact-forming arms engage the conductive inner surface of a cylindrical casing having a sandwich of elements therein extending between a conductive end wall of the casing, where a pellet of fusible material forms an end element of this sandwich of elements, and the opposite initially open end of the casing which is closed by an insulating cap. A pair of power leads preferably extends longitudinally into the opposite ends of the casing, one of the power leads being crimped or otherwise inseparably connected to the conductive end wall in the preferred form of the invention being described, and the other power lead extending through the insulating end cap. However, my cut-off link construction is vastly different from the Merrill and other prior ambient thermally actuated cut-off links in the manner now to be described.

In accordance with one of the features of the invention, the latter power lead and the deformable contact-forming arms are a single monolithic body made of relatively soft, low resistance material, like silver coated copper, so that there can be only one very low resistance separable contact interface between the power leads so that the switch is constructed with a minimum internal resistance to minimize internally generated heat. (This monolithic construction is to be contrasted with the spot welded connection between the spring metal contact arms and power lead of the said Plasko patent.) To this end, the one or more contact-forming arms engaging the casing are formed as an integral part of one of the power leads, so that there is no contact interface between the contact-forming arms and the associated power lead. While not required by the broader aspects of the invention, in the most preferred form thereof the power lead and contact-forming arms are made of relatively soft, very low resistance materials, like silver coated copper arms, when pressed against a curved inner face of the casing deform somewhat to increase the contact area to minimize contact resistance. (Spring metal materials which are used to make the contact-forming arms of the connectors of the prior arm described above exhibit inherently a much higher resistance and generally will not deform as much as a softer material under pressure to increase contact area to the same degree.) The sandwich of elements, including the pellet of fusible material referred to, includes an arm-deforming member and spring means which urges the arm-deforming member in a direction toward the contact-forming arms, so that when the pellet melts the arm-deforming member will deform the contact-forming arms away from the casing walls.

In accordance with another feature of the invention, the contact-forming arms are forced into a low resistance contact with the casing walls by means other than the resiliency thereof. To this end, the contact-forming arms, which preferably incline laterally outwardly from the end portion of the associated power lead, are pressed against a backing member comprising one of the elements in said sandwich of elements within the casing, which expands the arms outwardly against the casing. Over a range of pressures applied to the backing member, it was observed that the contact resistance between the control-forming areas and casing varies. Accordingly, in the cut-off link assembly procedure, after the sandwich of elements have been inserted within the open end of the casing and prior to closing the open end thereof with an insulating cap, the power lead from which the contact-forming arms extend is pressed inwardly toward the backing member with a progressively increasing force, until the measured contact resistance between the power leads drops to a predetermined desired value (like 0.9 milliohms when measured at probe joints on the leads spaced 1½ inches apart). When the contact resistance reaches this value, the power lead is anchored in its adjusted position. The force of the backing member against the contact forming arms will generally provide a lower contact resistance with the casing wall then is readily achievable by the force of a resilient contact-forming arm unaided by other forces, as in the above described prior art.

In accordance with a still further feature of the invention, to prevent any shifting in position of the backing member if the fusible pellet should creep, the spring means in said sandwich of elements within the fuse casing comprise a relatively weak, long, fully compressed spring and a relatively strong, short, partially compressed spring. The strong, short, partially compressed spring is located on the side of the backing member opposite to the side on which said arm-deforming member and relatively weak, long, fully compressed spring are located. The partially compressed, strong spring keeps the relatively weak spring fully compressed and eliminates any play in the sandwich of elements within the casing. The power lead having the contact-forming arms preferably extends through the relatively weak fully compressed spring and into the arm-deforming member, with the outwardly extending contact-deforming arms of the power lead extending outwardly through openings in the arm-deforming member which applies no pressure thereagainst, and making contact with the peripheral portion of the backing member whose position remains constant as long as the relatively weak spring remains fully compressed. Any creeping of the pellet of fusible material, preferably located between the partially compressed strong spring and the closed end of the casing, is taken up by movement of the latter spring and without causing any movement of the backing member. When the pellet melts at a given ambient control temperature, first the strong spring will expand and then the other spring will expand, immediately to force the arm-deforming member against the contact-forming arms of the power lead, to force the same away from the casing walls. In the most advantageous form of the invention, the arm-deforming member is made of insulating material and has a cavity into which the contact forming arms are fully retracted so as to be fully insulated from the casing walls.

In the initially conceived embodiment of my invention, said insulating cap enclosing the initially open end of the casing was a cured body of epoxy material which covered and hermetically sealed the initially open end of the casing. To this end, the power lead having the deformable contact-forming arms on the end thereof had one or more indentations therein into which the epoxy material flowed to anchor the same in a position around the power lead when the initially soft epoxy cement hardened upon curing the same. The adjusted force on the power lead was maintained until after the epoxy material was cured because the epoxy insulating cap was the anchoring means for the power lead forced toward the backing member. The epoxy material was cured by placing the completed cut-off link in an oven heated to a desirable temperature (obviously below the desired melting temperature of the pellet of fusible material used in the cut-off link involved). The epoxy material curing process takes a relatively long period of time encompassing a number of hours. This required cut-off link-holding fixtures and the pressure-applying means involved to remain with the cut-off links during the epoxy curing operation. While the broad aspects of the present invention deal with a cut-off link and a unique method of assembling the same which encompasses such a link and assembly method as just described, an improvement invention thereover provides an assembly method much easier to carry out because the adjusted force on the contact-forming arms is fixed automatically upon the initial assembly of a completed closure member (i.e. one not requiring any curing process to anchor the same) over the open end of the casing.

Two forms of closure members are disclosed in the present application. One of these closure members comprises a preferably longitudinally split compressible resilient member which initially loosely envelopes the contact arm-carrying power lead extending into the casing of the cut-off link. After the power lead has been forced against the backing member so as to produce a desired measured contact resistance, the outer edges of the initially opened casing are crimped around the split closure member to compress the same tightly against the power lead, to fix the position of the power lead in the casing and to fix the pressure of the expanded contact-forming arm against the backing member and casing walls.

The other preferred closure member (which was designed jointly by myself and John Borzoni) comprises a rigid body, like a ceramic member, having an inner end which engages and is forced against a preferably laterally projecting portion of the contact arm-carrying power lead, to force the same with the desired pressure against the backing member. This rigid closure member is then fixed in position by crimping the casing around the end of the closure member.

In both forms of closure members just described, epoxy cement is applied to the lines of juncture between the closure member and the casing and the first power lead, to hermetically seal these portions of the cut-off link. Since the closure member fixes the adjusted contact pressure of the cut-off link rather than the epoxy cement, the improved cut-off link can be placed in the epoxy-curing oven without the necessity of any special pressure applying fixtures accompanying the same into the furnace.

The above-described and other objects and features of the invention will become apparent upon making reference to the specification to follow, the claims and the drawings.

DESCRIPTION OF DRAWINGS

FIG. 1 is a perspective view, enlarged several times the actual size thereof, of a normally-closed ambient thermally actuated cut-off link constructed in accordance with the present invention;

FIG. 2 is a longitudinal sectional view through the cut-off link of FIG. 1, taken along section line 2—2 therein;

FIG. 3 is an enlarged fragmentary transverse section through the cut-off link shown in FIG. 2, taken along section line 3—3 therein;

FIG. 4 is a transverse sectional view through the entire cut-off link shown in FIG. 2, taken along section line 4—4 therein;

FIG. 5 is a sectional view corresponding to FIG. 2 after the cut-off link has been blown;

FIG. 6 is an elevational view through a unique hour glass-shaped coil spring in its uncompressed state, and which is incorporated in a compressed state in the modified form of the cut-off link shown in FIG. 8;

FIG. 7 is an end view of the coil spring of FIG. 6;

FIG. 8 shows a greatly enlarged fragmentary sectional view of a modified cut-off link similar to that shown in FIG. 2 except that the conical spring therein is replaced by the helical spring shown in FIG. 6;

FIG. 20 is an elevational view of the end portion of a long strand of wire from which the power lead, with the integral contact-forming arms, are formed for cut-off links of the modified construction shown in FIGS. 22–25;

FIG. 21 illustrates the first step in forming such a power lead element at the end of the strand of wire shown in FIG. 20;

FIG. 22 is a longitudinal sectional view through a modified cut-off link similar to the cut-off link shown in FIGS. 13–19, except that the modified power lead shown in FIG. 21 and a modified closure member has replaced the elements functionally corresponding thereto in the cut-off link of FIGS. 13–19;

FIG. 23 illustrates the initial step in the assembly of the parts of the cut-off link in FIG. 22 and shown the insertion of a sandwich of elements loosely within the initially open upper-end of the casing of the cut-off link;

FIG. 24 illustrates the application of external forces upon the closure member and power lead, which forces compress opposed coil springs and expand contact-forming arms of the power lead into a desired contact with the inner walls of the casing, as measured by a ohmmeter diagrammatically shown in FIG. 24; and FIG. 25 shows an enlarged sectional view of the upper-end of the cut-off link assembly shown in FIG. 24 after the closure member has been contacted snugly around the power lead and the upper edge of the casing has been crimped tightly around the closure member to fix the position of the closure member, power lead and other elements of said sandwich of elements within the casing, and after the application of an epoxy sealing cement over the exposed points of juncture between the closure member and casing and power lead.

DESCRIPTION OF EXEMPLARY EMBODIMENTS OF THE INVENTION

Figure 9:
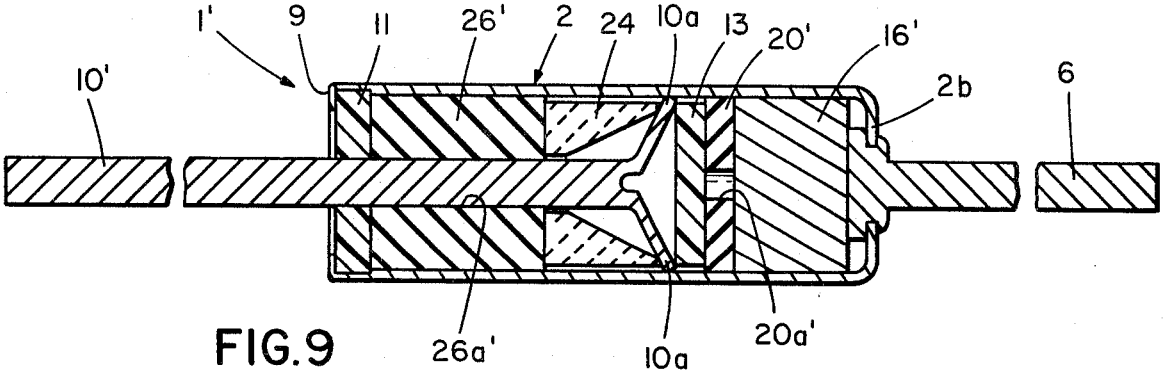
FIGS. 9 and 10 are longitudinal sectional views through a modified form of the normally-closed ambient thermally actuated cut-off link where the springs of the link are solid bodies of resilient compressible material, rather than coil springs as in the embodiment of FIGS. 1 through 4, and respectively show the link prior to and after the link has been blown.

Referring now more particularly to FIGS. 1 through 5, the ambient thermally actuated cut-off link there shown and generally indicated by reference numeral 1 includes a metal casing 2, which may be made of brass and having cylindrical walls 2*a*, which is preferably silver plated on the inside to a thickness of about 0.0002". The casing is initially open at one end and closed by an end wall 2*b* at the other end. The end wall 2*b* has an opening 4 through which a power lead 6 passes. The power lead terminates in an enlarged head 6*a* and is swaged over the outside of the casing end wall 2*b* to form a tight, low resistance, hermetically sealed connection therewith. The power lead 6 may comprise a tin plated copper wire.

The open end of the cylindrical wall 2*a* has a reduced readily deformable skirt 8 having an end portion 8*a* which is bent around the end of a closure washer 11 bearing against a shoulder 9 formed at the juncture between the reduced skirt 8 and the thicker portion of the cylindrical wall 2*a* of the casing 2. The closure washer 11, which in the proposed commercial form of the invention is made of a glass filled melamine material, has an opening 11*a* therein through which passes a power lead 10 extending into the initially open end of the casing 2. The power lead 10 has an anchoring indentention 12 into which extends a body of epoxy cement 14 or the like which hermetically seals the end of the casing, further insulates the power lead 10 from the casing at this point and anchors the power lead 10 in an adjusted position to be described.

The power lead 10 in the proposed commercial form of the invention is an annealed, 18 gauge copper wire having a tensile strength of 30,000–35,000 lbs. per square inch and a 0.0002" coating of silver thereover. The power lead 10 may be formed from a stock of copper wire with longitudinally elongated and spaced apertures (one of which forms the aperture 15 extending completely through the wire stock shown in FIG. 2). The copper wire stock is then cut laterally along the apertures to form individual power leads each having a longitudinal open slot at the end thereof, the portion of each lead on opposite sides of the end portion of each slot being bent outwardly to form a bifurcated end defining contact-forming wings or arms 10*a*—10*a*. The copper power lead is then silver plated.

The power lead 10 passes through a spring biased sandwich of elements to be described and extends between the closure washer 11 and the end wall 2*b* of the casing 2. In the normally-closed version of the invention shown in the figures now being described, the contact-forming arms 10*a*—10*a* at the then inner end of the power lead 10 are pressed against a backing member 13 which expands the arms 10*a*—10*a* into engagement with the cylindrical silver coated inner wall surface of the cylindrical wall 2*a* of the casing 2. The copper wire used to form the power lead 10 is a soft readily deformable copper so that the arms 10*a*—10*a* when expanded into engagement with the silver coated inner walls of the casing 2 will deform somewhat to make contact over a given area greater than that provided by a point contact with the casing, as best illustrated in FIGS. 2 and 3, ensuring an unusually total low contact resistance of, for example, under 1 milliohm per cut-off link. In the assembly of the cut-off link 1, before the epoxy cement 14 is applied, the contact resistance between the arms 10*a*–10*a* and the casing walls is adjusted to a given desired low value by progressively increasing the inward pressure of the power lead against the backing member 13 until a measurement of this contact resistance reaches the desired value. While maintaining the power lead in this adjusted position, the epoxy cement 14 is applied and allowed to harden to form an end cap which seals the end of the casing 2 and anchors the power lead in the adjusted position, and the internal resistance of the cut-off link remains at its adjusted value.

The aforementioned sandwich of elements includes, in addition to the backing member 13 preferably made of insulating material like glass filled melamine, a pellet 16 of fusible material which will melt at a given control temperature, a metal pressure-distributing disc 18, a relatively short, strong coil spring 20, an insulating arm-deforming member 24 and a relatively weak, long coil spring 26. The coil springs 20 and 26 may be made of music wire. The pellet 16 is located between the head 6*a* of the power lead 6 and the pressure-distributing disc 18. The pellet is preferably formed by compacting a granular mixture of fusible material against the closed end of the casing. This achieves a much more intimate engagement between the fusible material and the casing walls, to increase heat conducitivity to the pellet. If a self-supporting fusible pellet were to be inserted into the open end of the casing 2 during the manufacture of the cut-off link, the pellet would initially have to be of somewhat smaller dimensions than the inside diameter of the casing, which would interfere with the transmission of heat thereto through the walls of the casing if the pellet were not compacted and expanded into intimate contact with the casing wall. While a very soft pellet could be so compacted, this would not generally achieve the same intimate contact between the pellet and the casing wall as when a granulated material is compacted. Also, fusible pellets are generally relatively rigid bodies making their substantial compression difficult if not impractical to achieve when placed inside the very tiny casings used for thermal cut-off links.

The relatively short, strong, compressed coil spring 20 is shown in FIG. 2 sandwiched in a partially compressed state between the pressure-distributing disc 18 and the right side of the backing member 13. The coil spring 20 is shown as a conical coil spring whose wide end presses against the peripheral portions of the pressure-distributing disc 18. It was found that the pressure of the coil spring 20 on the pressure-distributing disc is better distributed over the pellet 16 when the wide end of the coil spring engages the pressure-distributing disc 18 than when the narrow end engages the same. The arm-deforming member 24, which is preferably made of hard ceramic material, has a pair of flat-ended bosses 24*d*—24*d* bearing against the left side of the backing member 13 as viewed in FIG. 2. The arm-deforming member 24 is shown having a cylindrical passageway 24*a* through which the power lead 10 freely passes, which cylindrical passageway joins a conically-shaped arm-deforming cavity 24*b* which opens onto the end of the arm-deforming member 24 through an outwardly facing opening 24*c* defined between the bosses 24*d*–24*d*, and also communicates to the exterior of the member through laterally facing openings 24*e*—24*e*, which provide clearance openings for the arms 10*a*—10*a* extending outwardly beyond the confines of the arm-deforming member 24.

The relatively weak, long coil spring 26 is fully compressed between the arm-deforming member 24 by the force of the short, strong conical coil spring 20 which also eliminates any play in the sandwich of elements referred to. Because the coil spring 26 remains fully compressed at all times prior to the melting of the pellet 16, it is apparent that the backing member position remains fixed, and so the pressure and contact resistance between the power lead contact-forming arms 10*a*—10*a* expanded by their engagement with the backing member 13 against the casing 2 remains constant, even if the fusible pellet 16 creeps.

When the environment in which the cut-off link is placed reaches the desired control temperature, the fusible pellet 16 melts, causing the initial expansion of the stronger conical coil spring 20, following which the longer coil spring 26 will fully expand to force the arm-deforming member 24 to the right as viewed in the drawings. The movement of the arm-deforming member 24 to the right will collapse the arms 10*a*—10*a* within the cavity 24*b* thereof, as shown in FIG. 4. The pressure-distributing disc 18, as well as the backing member 13 and the arm-deforming member 24, are made of a size somewhat smaller than the interior dimensions of the casing, so that there is clearance for the flow of the melted fusible material throughout the cut-off link, as illustrated in FIG. 4.

Refer now to FIGS. 6 through 8 which shows an off-centered, hour glass shaped coil spring 20*a* developed by Murray Clay. The coil spring, which is preferably made of music wire, is a preferred replacement for the conical coil spring 20 in FIG. 2. The coil spring 20*a* has outermost spiral turns 21 and 23 which are the coils of maximum diameter at opposite ends of the coil, and off-centered turns 25 and 27 of lesser diameter between the same. As best shown in FIG. 8, these various turns of the coil are off centered in a manner so that when the coil is compressed, the contiguous portions of the turns will overlap partially and nestle together, as shown in FIG. 8, so that the longitudinal dimensions of the compressed spring are reduced from that of a conventional hour glass helical coil spring. (In the latter coil spring, the opposite halves of the coil spring are symmetrical so that the collapsing thereof will cause corresponding turns to be in alignment where they cannot nestle one within the other.) This unique spring construction enables the spring to be of a minimum size in its collapsed condition, while having the capability of following the creeping of the fusible pellet 16 and retaining sufficient force to keep the other coil spring 26 fully compressed.

Figure 10:
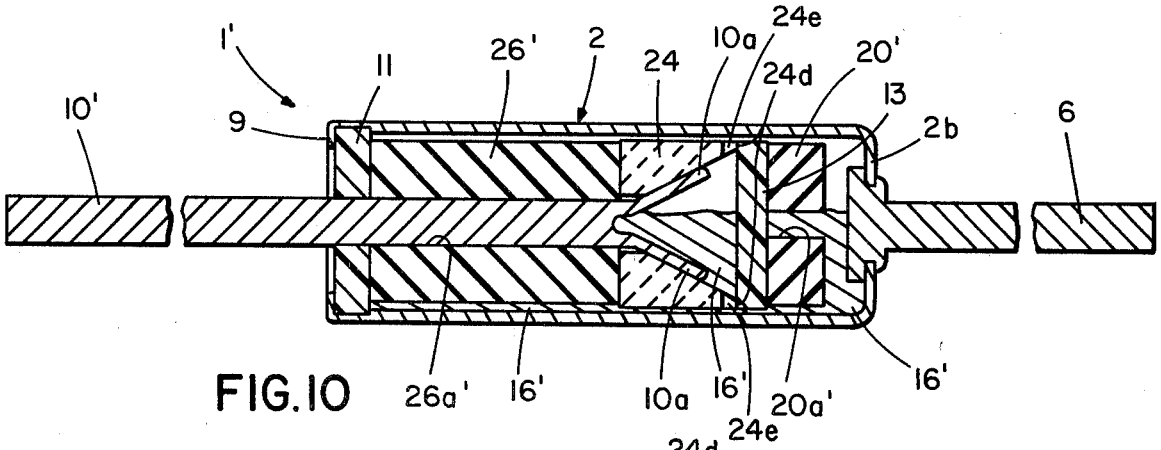

Refer now to FIGS. 9 and 10 showing a preferred, normally-closed cut-off link 1' which replaces the coil spring means 20 or 20*a* and 26 with solid bodies 20' and 26' of resilient compressible material, like silicone rubber. This form of the invention has the advantage that it comprises a smaller number of parts and assembly operations, and so can be made at a lesser cost than the cut-off link 1 shown in FIGS. 1 through 5. Also, it can be more easily assembled with automated assembly equipment since coil springs are, unlike solid bodies of resilient compressible material, difficult to handle and drop into proper position within the case 2 with such equipment. The fewer number of parts used in the cut-off link results from the fact that the cut-off link 1' does not require the epoxy cement 14 or the pressure-distributing disc 18 needed in the cut-off link 1. The solid body 20' of resilient compressible material is shown having a central opening 20*a'* forming a clearance opening for the flow of the pellet material when the pellet melts at the control temperature of the fuse. The silicone rubber body 20' is partially compressed and is a strong spring means to fully compress the other silicone rubber body 26'. The power lead 10' passes through longitudinal opening 26*a'* in the silicone rubber body 26'. The compression of the silicone rubber bodies 20' and 26' causes them to expand radially inwardly and outwardly to make a hermetic sealing with the interior walls of the casing 2 and, in the case of the body 26', with the power lead 10'.

In the form of the invention shown in FIGS. 9 and 10, the assembly operation used therefor comprises dropping the pellet 16', silicone rubber body 20' and backing member 13 into the bottom of the casing 2 oriented with the open end up, following which the assembly of the power lead 10', the arm-deforming member 24, the silicone rubber body 26' and the closure washer 11 are dropped into the casing 2. A given predetermined downward pressure is then applied to the power lead 10' until the desired contact resistance is measured between the contact-forming arms 10a—10a and the casing walls. The silicone rubber body 20' then becomes partially compressed as shown in FIG. 9. Then, the closure washer 11 placed against the casing shoulder 9 is secured in place by bending the end portion 8a of the casing skirt 8 around the end of the closure washer. With the closure washer 11 held against the shoulder 9, the forces applied to the sandwich of elements within the casing are such as to cause full compression of the silicone rubber body 26' and the inward and outward expansion thereof to form a seal with the casing 2 and the power lead 10', which becomes frictionally locked in place to maintain the desired contact resistance between the arms 10a—10a and the casing 2.

Figure 11:
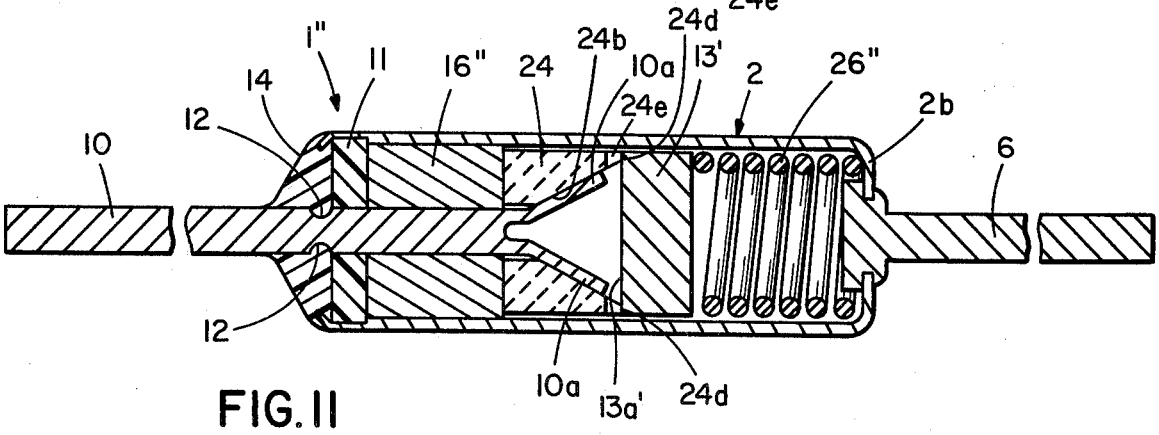
FIGS. 11 and 12 respectively show a form of the invention constituting a normally-open ambient thermally actuated switch respectively before and after the switch has been subjected to the control temperature thereof.
Figure 12:
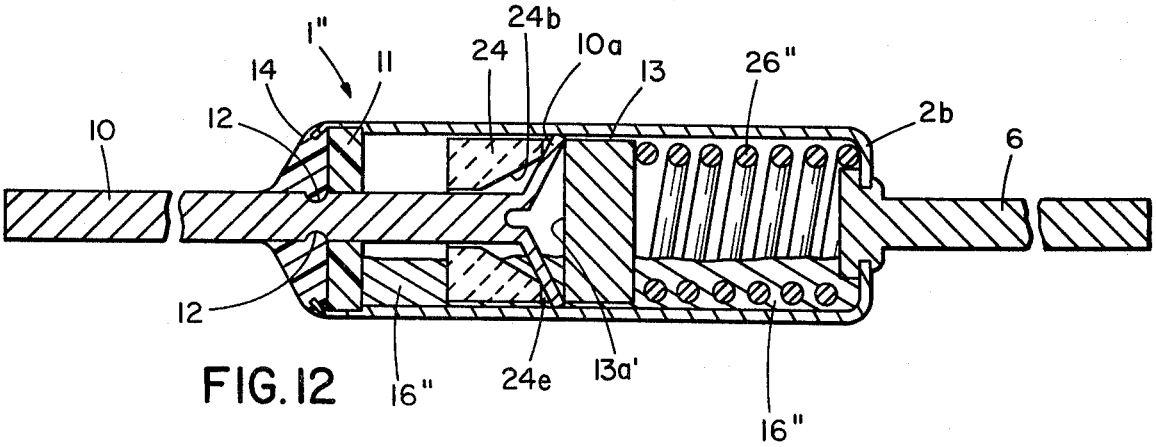
Figure 13:
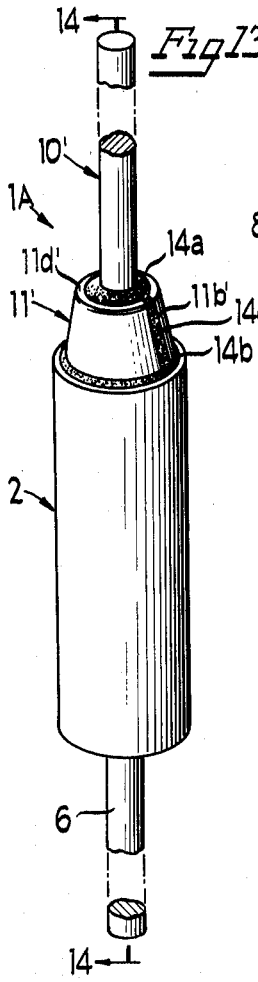
FIG. 13 is a perspective view, enlarged several times the actual size thereof, of a normally-closed ambient thermally actuated cut-off link constructed in accordance with the present invention.

There may be certain applications of an ambient cut-off link when it is to be normally-open, so that an electrical control circuit becomes energized when the cut-off link is in an environment which heats up to the control temperature for the cut-off link. In such case, the cut-off link 1" of the invention preferably has the construction shown in FIGS. 11 and 12, to which reference is now made. Many of the parts of the fuse 1", like casing power leads 6 and 10, closure washer 11, epoxy end cap 14 and arm-deforming member 24, are identical to the corresponding elements of the cut-off link of FIG. 1, and so the constructional details thereof need not be described further. The normally-open cut-off link 1" needs only a single coil spring 26" which is illustrated as being located at the closed end of the casing 2. The coil spring 26", which is in a partially compressed state as shown in FIG. 10, is sandwiched between the end wall 2b of the casing 2 and one end of a backing member 13' which is shown somewhat thicker than the corresponding member 13 in the cut-off link 1. The backing member 13' has a flat end face 13a' which, when the backing member 13' is pushed against the contact-forming arms 10a—10a of power lead 10, will expand the arms 10a—10a laterally outwardly into engagement with the casing walls and press the same thereagainst to form a good low resistance contact therewith.

The contact-forming arms 10a—10a of the power lead 10 are initially confined within cavity 24b of arm-deforming member 24. The backing member 13' bears against the flat faces of the spaced bosses 24d—24d at one end of the arm-deforming member 24. The other end of the arm-deforming member 24 bears against one end of a pellet 16" of fusible material. The other end of the pellet 16" abuts against the closure washer 11. When the pellet 16" melts, the spring 26" presses the backing member 13' and the arm-deforming member 24 to the left as viewed in the drawings, causing the contact-forms arms 10a—10a to pass out of the cavity 24b where they are engaged by the flat end face of backing member 13' and forced into engagement with the interior of the casing, as, shown in FIG. 12.

Refer now more particularly to FIGS. 13-19 which show an improved normally-closed cut-off link 1A which is substantially identical to the cut-off link of FIGS. 1-5 except that it has the hour glass coil spring of FIGS. 6 and 7 and a closure member 11' which replaces the closure body 14 of epoxy material. This closure member overcomes a problem involved in the assembly of the cut-off link when a closure of epoxy material is used to close the casing and to fix the adjusted pressure on power lead 10. Such an epoxy material forming this closure means is cured by placing the completed cut-off link in an oven heated to a desirable temperature (obviously below the desired melting temperature of the pellet of fusible material used in the cut-off link involved). The epoxy material curing process takes a relatively long period of time encompassing a number of hours, and so it is necessary to maintain the adjusted external force on the bifurcated contact-forming arm-carrying power lead until the curing operation is completed. This requires the cut-off link holding fixtures to remain attached to the cut-off links during the epoxy curing operation. In the form of the invention of FIGS. 13-19, the adjusted force on the contact-forming arms is fixed automatically upon the anchoring of a completed closure member 11' (i.e. one not requiring any curing process to anchor the same) over the open end of the casing.

The closure member 11' is made of a resilient compressible insulating material, which maybe a high temperature resin (like TORLON grade 4203, manufactured by Amoco Chemicals Corporation). The closure member 11' bears against a shoulder 9 formed at the juncture between the reduced skirt 8 and the thicker portion of the cylindrical wall 2a of the casing 2. The closure member 11' has an opening 11a' therein through which passes the shank portion 10b' of a power lead 10' extending into the initially open end of the casing 2.

The closure member 11' is split at 11b' along the entire length thereof so as to form a split ring-like member where said opening 11a' is initially larger than the diameter of the cylindrical shank portion 10b of the power lead 10'. The split closure member 11' is forced snugly around the power lead 10' by the force of the end portion 8a of the casing skirt 8 swaged therearound. THe outer end of the closure member 11' has an annular neck portion 11d' which defines with the shank portion 10b' of the power lead 10' an annular well 11d". A glob 14a of epoxy cement fills this well 11d" to form a hermetic seal between the power lead 10' and closure member 11'. A glob 14b of epoxy cement is also placed over the circular line of juncture between the swaged end portion 8b of the casing skirt 8 and the closure member 11'. A seam of epoxy cement 14c is also placed over the opening at the juncture of surfaces 11b' as shown in the drawings.

In the assembly of the cut-off link 1a, before the split closure member 11' is contracted around the power lead 10', the contact resistance between the power lead contact-forming arms 10a'—10a' and the casing walls is adjusted to a given desired low value by progressively increasing the inward pressure of the power lead against the backing member 13 until a measurement of this contact resistance reaches the desired value. The split closure member 11' is then squeezed tightly around the power lead 10' by crimping the casing skirt around the closure member flange 11c' before the adjusted pressure is relieved from the power lead. This adjustment procedure will now be described in connection with FIGS. 16-18, to which reference is now made.

Figure 14:
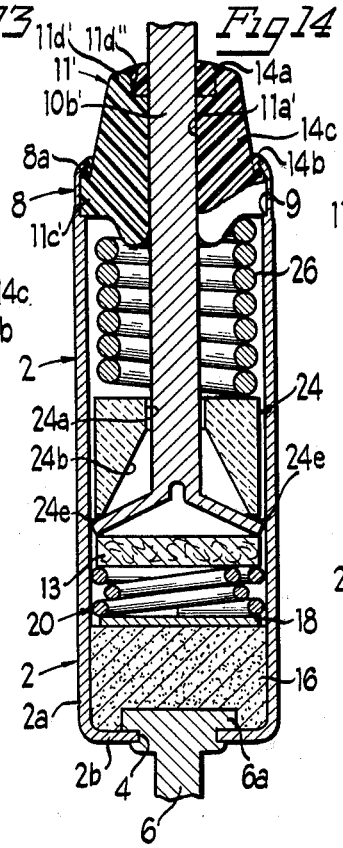
FIG. 14 is a longitudinal sectional view through the cut-off link of FIG. 13, taken along section line 14—14 therein.
Figure 15:
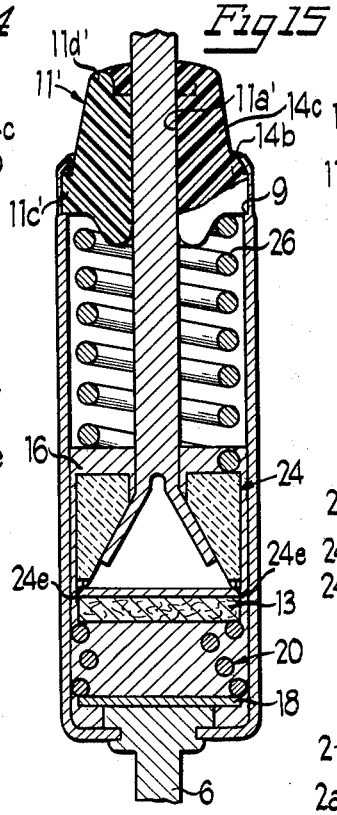
FIG. 15 is a sectional view corresponding to FIG. 14 after the cut-off link has been blown.
Figure 16:
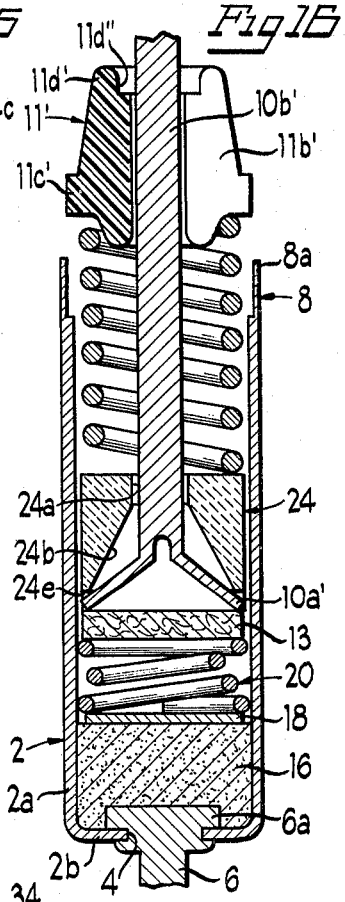
FIG. 16 illustrates the initial step in the assembly of the parts of the cut-off link of FIGS. 13–15, and shows the insertion of a sandwich of elements loosely within the initially open upper-end of the casing of the cut-off link.
Figure 18:
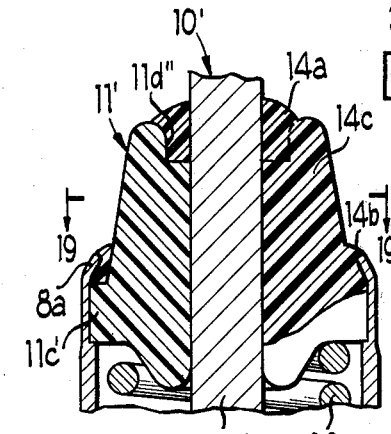
FIG. 18 shows an enlarged sectional view of the upper-end of the cut-off link assembly shown in FIG. 17 after the split closure member has been contracted snugly around the power lead as the upper edge of the casing has been crimped tightly around the closure member to fix the position of the closure member, the power lead and other elements of said sandwich of elements within the casing, and after the application of an epoxy sealing cement over the previously exposed points of juncture between the closure member and casing and power lead.
Figure 19:
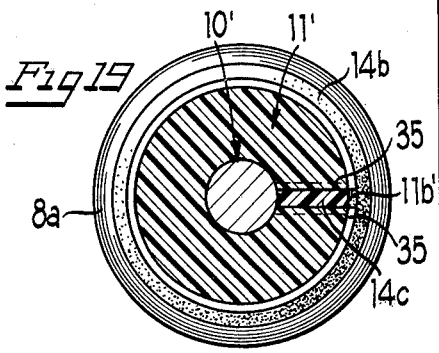
FIG. 19 is a horizontal sectional view through the closure member of FIG. 18, taken along section line 19—19 therein.
Figure 17:
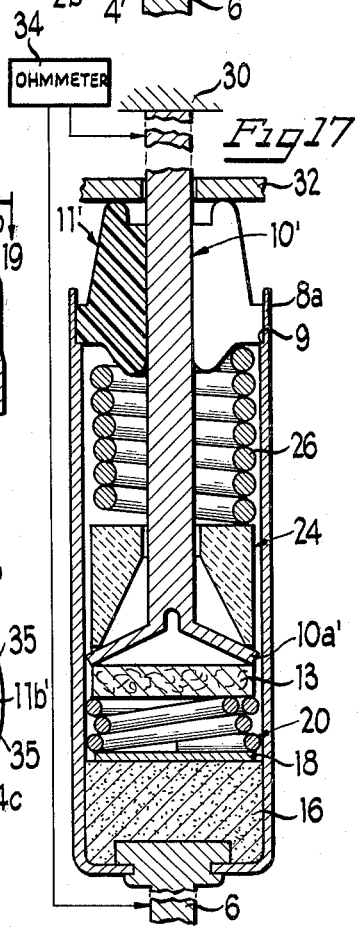
FIG. 17 illustrates the application of external downward forces upon a split-closure member and power lead, which forces compress opposed coil springs and expand contact-forming arms of its power lead into contact with the inner walls of the casing as measured by an ohmmeter diagrammatically shown in FIG. 17.

To assemble the various fuse elements within the casing 2, the casing is oriented so that the initially open end thereof which receives the closure member 11' faces upwardly to receive the different elements which are then sequentially dropped into the then bottom portion of the casing in the order in which these elements are to be located within the casing, as shown in FIG. 14. Next, force-applying means, like plungers 30 and 32, are respectively brought down against the upper ends of the power lead 10 and the closure member 11', respectively. As shown in FIG. 17, the plunger 32 is forced downwardly to bring the bottom of the flange 11c' of the closure member 11' against the shoulder 9 of the casing wall at the inner end of the skirt 8, which is in an undeformed (i.e. straight upwardly extended) position. This positioning of the closure member 11' compresses the springs 20 and 26. An ohmmeter 34 is electrically connected between corresponding points of the power leads 6 and 10' (e.g. at points spaced ½ inch from the exposed inner end portions of these leads.) The plunger 30 is moved downwardly to press the contact-forming arms 10a'—10a' against the backing member 13 with a force which causes these arms to spread outwardly against the inner surface of the casing 2 with a force to provide the desired contact resistance between the arms 10a'—10a' and the casing walls (which represent most of the resistance measured by the ohmmeter 34). When the ohmmeter measures the desired resistance, which resistance progressively decreases as the downward force on the power lead 10' is progressively increased, the end portion 8a of the skirt portion 8 of the casing is then swaged tightly around the flange 11c' of the closure member (which initially provided a substantial gap defined between the dashed lines 35—35 in FIG. 19). The closure member is then locked in place on shoulder 9 and is fixedly tightened around the shank portion 10b' of the power lead 10', as shown in FIG. 18, where the desired force on the power lead is maintained after the plunger 30 is removed from the power lead 10a.

Next, globs 14a, 14b and seam 14c of expoxy cement are applied to the space in the split 11b' of the closure member and to the juncture points between the closure member 11'' and the casing 2 and power lead 10' (i.e. over the swaged portion of the casing skirt and adjacent power lead surface and in the well 11d''), to hermetically seal the initially open end of the casing. The epoxy cement, of course, is initially applied in an uncured, softened condition. The cement is then cured by placing the completed cut-off link in an oven and elevating the same to a desired curing temperature. The particular curing temperature utilized depends upon the temperature rating of the cut-off link. Since curing takes at least several hours, the exact time being an inverse function of the curing temperatures, the highest curing temperature is selected that the pellet 16 can safely withstand. The closure member 11' is made of a high temperature resin material which can withstand the curing temperature involved. (For example, in one case, the curing temperature was 66° C. and the curing time of the epoxy cement utilized was 1 hour.) As previously indicated, the curing of globs 14a and 14b and seam 14c of the epoxy cement does not require may special holding fixtures for the cut-off link, which greatly simplifies the curing process.

FIGS. 22–25 disclose an alternate normally-closed cut-off link construction 1B which provides for an advantageous assembly and contact resistance-adjusting procedure similar to that just described. The cut-off link 1B has a closure member 11'' and power lead 10'' somewhat different from the closure member 11' and power lead 10' used in the cut-off link previously described. Thus, the closure member 11'' is a solid body of a rigid material, which may be a suitable ceramic material. This closure member 11'' has a central opening 11a'' which is permanently larger than the diameter of the shank portion 10b'' of the power lead 10'' passing therethrough In most other respects, the shape of the closure member 11'' illustrated is similar to the shape of the closure member 11' previously described, except that it has no longitudinal split therein.

The inner or bottom end of the shank 10b'' of the power lead 10'' is located just beyond the bottom portion of the closure member 11'' which has an annular lip 11e'' adapted to bear against an outwardly axially facing shoulder 38 formed by a resilient expanded portion of the power lead shank 10b''. The annular lip 11e' presses against the resilient expanded portion of the power lead to provide the desired downward or inward pressure on the power lead 10''.

The assembly and adjusting procedure used with the form of the invention now being described is shown in FIGS. 23,24 and 25. Accordingly, FIG. 23 illustrates the initial assembly of the various interior elements of the cut-off link 1B when dropped in proper sequence into the open end of the casing 2. FIG. 24 illustrates the bringing of a plunger 32 down upon the upper end of the closure member 11''. After the plunger 32 is moved downwardl it compresses the springs 20 and 26 and forces the power lead and contact-forming arms downwardly. The final position of the closure member 11'' is determined by the point at which the contact resistance between the contact-forming arms 10a''—10a'' and the casing measured by ohmmeter 34 reaches its desired value. (To ensure uniformity of the control temperatures of identically rated cut-off links, the position of the shoulder 38 of the power lead 10'' is selected to achieve the end that the desired contact resistance is obtained before the closure member flange 11c'' reaches casing shoulder 9). When the ohmmeter measurement reaches the desired resistance, the initially straight end portion 8a of the casing skirt 8 is crimped tightly around the closure member flange 11c''. Globs 14a' and 14b' of epoxy are placed in the well 11d'' between the power lead 10'' and closure member 11'' and between the casing skirt 8a and the closure member 11''.

The power lead 10'' can be mass produced to close tolerances in a simple manner using the fabrication steps illustrated in FIGS. 20 and 21, to which reference should now be made. Individual power leads 10'' are formed from a long cylindrical strand of wire 40, the end portion of which is shown in FIG. 20. Formed in this strand of wire are relatively closely spaced pairs of axially elongated apertures 15—15'. The pairs of apertures 15—15' are spaced apart so that there is sufficient wire material therebetween to form one power lead 10'' and associated outwardly inclining contact-forming arms 10a''—10a''. The end portions of these apertures are rounded whereas the intermediate portions thereof preferably have parallel margins. Initially, the end of the strand of wire 40 is severed so that the forwardmost aperture 15 opens onto the end of the strand of wire along parallel aperture margins. Initially, the resulting wings 10a''—10a'' defining the first aperture 15 are bent outwardly to form the contact-forming arms 10a''—10a'' as shown in FIG. 21. Then, the wire is severed at a first point P1 which defines the outer end of the severed power lead element 10'' and at a second point P2 which opens the outer end of the forwardmost aperture 15 of the next pair of apertures 15—15', so that another power lead 10'' can be formed in the manner just described.

The power lead 10 used in the form of the invention shown in FIGS. 1–5 can be formed by a process similar to that just described, except that the strand of wire has only one aperture 15 in each length of wire to form one power lead.

It should be apparent that the method and article aspects of the present invention provide a reliable and inexpensive cut-off link and method of making the same, resulting in reliable mass production of cut-off links, with substantially identical operating temperatures.

It should be understood that numerous modifications may be made in the most preferred forms of the present invention described, without deviating from the broader aspects thereof.

I claim:

1. An ambient thermal switch comprising: a casing of electrically conductive material; a first power lead in said casing exposed to the outside of said casing through an opening in said casing where it is insulated therefrom, said first power lead having at the inner end thereof deformable contact-forming arm means for making a low resistance contact with the inner conductive surface of said casing when expanded outwardly to a given degree; a second exposed power lead making a permanent low resistance connection with said casing; a sandwich of serially located elements urged under spring pressure between fixed spaced points in said casing and including stressed spring means, arm-deforming means for deforming said arm means inwardly out of contact with said casing, backing means for said arm means for expanding said arm means against said casing to establish a given low resistance contact therewith, and a fusible body which melts at a given control temperature causing the stressed spring means to move to an unstressed state, said spring, arm-deforming and backing means being positioned for causing one of said arm-deforming and backing means to move against said arm means when the spring means moves to its unstressed state and effecting the expanding or contracting of said contact-forming arm means.

2. The ambient thermal switch of claim 1 wherein said contact-forming arm means forms an integral part of said first power lead so that the interface between said arm means and casing is the only separable contact interface between said power leads.

3. The ambient thermal switch of claim 1 or 2 wherein said casing has a curved inner conductive surface contacted by said arm means, and said arm means is made of a relatively soft highly conductive material which when pressed against said casing deforms to engage the switch over a greater area.

4. The ambient thermal switch of claim 1 wherein said arm-deforming means is a body of insulating material having a cavity therein, and said contact-forming arm means when deformed by said arm-deforming means being fully retracted into said cavity so that the body of insulating material fully insulates the arm means from the casing.

5. The ambient thermal switch of any of the preceding claim 1 wherein said fusible body is a body of fusible granular material compressed into said closed end of the casing so it expands and closely engages the exposed inner surfaces of the casing, to enable external heat to readily pass into said compressed body of fusible material.

6. An ambient thermal actuated cut-off link comprising: a casing of electrically conductive material; a first power lead in said casing exposed to the outside of said casing through an opening in said casing where it is insulated therefrom, said first power lead having at the inner end thereof laterally outwardly extending, inwardly deformable contact-forming arm means making a low resistance contact with the inner conductive surface of said casing; a second exposed power lead making a permanent low resistance contact with the inner conductive surface of said casing; a second exposed power lead making a permanent low resistance connection with said casing; a sandwich of serially located elements urged under spring pressure between fixed spaced points in said casing and comprising first fully compressed spring means, arm-deforming means on one side of said arm means and urged by said fully compressed spring means toward said arm means to deform the same inwardly when the fully compressed spring means is allowed to expand, backing mean on the other side of said arm means and against which said arm means bear and are expanded against said casing to establish a given low resistance contact therewith, second compressed spring means for keeping said first spring means fully compressed and for taking up any play in said sandwich of elements, and a fusible body which melts at a given control temperature, said backing means being located between said fully compressed spring means and second spring means so that the position of said backing means is fixed within said sandwich of elements as long as said fully compressed means remains full compressed, whereby the contact resistance between said arm means and casing does not vary with the degree of compression of said second spring means, the melting of said body of meltable material at said control temperature first causing said second spring means to expand, after which said fully compressed spring means expand to force said arm deforming means against said contact-forming arm means to disengage the same from said casing.

7. The ambient thermal cut-off link of claim 6 wherein said arm means forms an integral part of said first power lead so that the interface between said arm means and causing is the only separable contact interface between said power leads.

8. The ambient thermal cut-off link of claim 6 wherein said solid body of meltable material is spaced from said fully compressed spring means and arm-deforming means, and said arm-deforming means is positioned immediately contiguous to said arm means, so that initiation of outward expansion of said fully compressed spring means will cause immediate inward deformation of said arm means.

9. The ambient thermal cut-off link of claim 6 wherein said casing has a curved inner conductive surface contacted by said arm means, and said arm means is made of a relatively soft highly conductive material which when pressed against said casing it forms to engage the same over a greater area.

10. The ambient thermal cut-off link of claim 8 or 9 wherein said arm means are integral with said first power lead, so that no separable contact-interface is formed therewith, the interface between said arm means and casing thus being the only separable contact interface between said power leads.

11. The ambient thermal cut-off link of claim 6 wherein said sandwich elements comprises, in the order named, said first fully compressed spring means, arm-deforming means positioned immediately between said fully compressed spring means and said arm means, backing means, second spring means, and fusible body.

12. The ambient thermal cut-off link of claim 6 wherein said arm means extends laterally outwardly into engagement with said casing through apertures in said arm-deforming means.

13. The ambient thermal cut-off link of claim 11 wherein said second spring means is located between said fusible body and said backing means.

14. The ambient thermal cut-off link of claim 13 wherein said sandwich of elements include a first pressure-distributing disc between said second spring means and said fusible body, and said second spring means being a coil spring.

15. The ambient thermal cut-off link of claim 14 wherein a coil of said second spring means engages the pressure-distributing disc at the perimeter thereof.

16. The ambient thermal cut-off link of claim 6 wherein said fully compressed spring means and said second spring means are both solid bodies of compressible resilient material spaced apart on opposite sides of said deformable contact-forming arm means, said spring means under compression being expanded to form a hermetic seal with said casing walls.

17. The cut-off link of claim 16 wherein said first power lead passes through said fully compressed spring means which is expanded inwardly by the force from said second spring means into hermetic sealing relationship with said first power lead.

18. An ambient thermal cut-off link comprising: a casing of electrically conductive material having inner conductive surfaces; a first power lead extending longitudinally into one end of said casing at a point where it is insulated therefrom, said first power lead terminating within said casing in laterally outwardly extending, inwardly deformable contact-forming arm means making a low resistance contact with said curved inner conductive surface of said casing and which are integral with said first power lead so that no separable contact interface is formed therewith; a second power lead extending longitudinally into the other end of said casing and making a permanent low resistance connection with said casing, the interface between said arm means and casing thus being the only separable contact interface between said power leads; a longitudinally extending sandwich of elements held under spring pressure located between the ends of said casing and comprising, in the order named, first fully compressed spring means, arm-deforming means positioned immediately between said fully compressed spring means and said arm means and urged by said fully compressed spring means toward said arm means to deform the same inwardly when the fully compressed spring means is allowed to expand, backing means for said arm means against which said arm means bear and are expanded against said casing to establish a given low resistance contact therewith, partially compressed spring means for taking up any play in said sandwich of elements, and a fusible body which melts at a given control temperature and is engaged by said other end of said casing at the sides thereof to efficiently receive heat externally of the casing thereto, said backing means being located between said fully compressed spring means and partially compressed spring means so that the position of said backing means is fixed within said sandwich of elements as long as said fully compressed means remains fully compressed, whereby the contact resistance between said arm means and casing do not vary with the degree of compression of said partially compressed spring means; the melting of said fusible body at first causing the partially compressed spring means to expand at said control temperature after which said fully compressed spring means forces said arm-deforming means against said arm means to disengage the same from said casing.

19. A method of making an ambient thermally actuated switch comprising a casing of electrically conductive material having at least one initially open portion to receive switch-forming elements during the assembly of the switch; a first exposed power conductor within and insulated from said open portion of said casing and associated laterally outwardly inclining contact-forming arm means initially in electrical contact with a conductive surface associated with said casing; a sandwich of elements within said casing, said sandwich of elements including arm-deforming means contiguous to one side of said contact-forming arm means and adapted when forced thereagainst with a given force to contract and bend said contact-forming arm means away from said conductive surface, a backing member on the opposite side of contact-forming arm means against which member said contact-forming arm means are forced to expand the same into good electrical contact with said conductive surface, spring means, and a fusible body of material which melts at a given control temperature, said spring means being in a stressed condition while the fusible body remains unmelted and moving to an unstressed state to push said arm-deforming means against said arm means to move the same out of contact with said conductive surface; and closure means closing said initially open portion of said casing so that it maintains said spring means in said stressed condition to force said contact-forming arm means against said backing member; said method comprising; inserting said sandwich of elements and said first power conductor and associated contact-forming means into said casing, then externally forcing said closure means against said sandwich of elements and said first power conductor and contact-forming arm means toward said backing member, to stress said spring means and force said contact-forming arm means against said backing member so as to expand said contact-forming arm means into forced engagement with said casing, adjusting said force against said first power conductor and contact-forming arm means to a value such that the contact resistance measured between said casing and said contact-forming arm means is at a desirably low predetermined value, and, while maintaining said adjusted force on said first power conductor, permanently anchoring said closure means over said initially open portion of said casing to fix the stress on said spring means and the pressure of said contact-forming arm means against said conductive surface.

20. The method of claim 19 wherein said closure means is a resilient contractible member which is initially inserted within said open portion of said casing where it loosely surrounds said first power conductor, said anchoring of said closure means contracting said casing tightly around said first power conductor before said external forces thereon are released.

21. The method of claim 20 wherein said closure means is anchored over said initially open portion of said casing by crimping the casing walls snugly around an external portion of the closure means to contract the same around said first power conductor.

22. The method of claim 19 wherein said casing is a cylindrical casing and said conductive surface is the inner surface of said casing.

23. The method of claim 19 wherein said contact-forming arm means is an integral portion of said power conductor so that there is no contact interface between the same.

24. The method of any of claims 19 through 23 wherein said contact-forming arm means incline laterally outwardly in a direction away from said open portion of said casing, said backing member being on the outside of said arm means and said arm-deforming means being on the inside of said arm means, and said contact-forming arm means being forced inwardly by said externally applied force prior to the anchoring of said closure means.

25. The method of claim 20 or 21 wherein, after said closure means has been anchored in place to fix the stress on the spring means and the pressure of said contact-forming arm means against said conductive surface, applying a synthetic plastic material to the lines of juncture between said closure means and said casing and first power conductor, and after releasing the external forces on said closure means and first power conductor, placing the switch in an environment elevated to the curing temperature of said synthetic plastic material.

26. An ambient thermal actuated cut-off link comprising: a casing of electrically conductive material; a first power lead exposed to the outside of said casing through an opening in said casing at a point where it is insulated therefrom, said first power lead having at the inner end thereof laterally outwardly extending, inwardly deformable contact-forming arm means making a low resistance contact with an inner conductive surface associated with said casing; a second exposed power lead making a permanent low resistance connection with said casing; a sandwich of serially located elements urged under spring pressure between fixed spaced points in said casing and comprising stressed spring means, arm-deforming means on one side of said arm means which arm-deforming means is urged by said spring means toward said arm means to deform the same inwardly when the spring means is allowed to move to the unstressed state thereof, backing means for said arm means on the other side of the same and against which backing means said arm means is urged to expand the same against said casing to establish a given low resistance contact therewith, and a fusible body which melts at a given control temperature, the melting of said body of meltable material at said control temperature causing said spring means to move to an unstressed state to force said arm-deforming means against said contact-forming means to bend the same away from said casing; and closure means anchored in and sealing said casing opening, said closure means being a resilient contracted member into which said first power lead extends and around which the defining walls of said casing opening extend to contract the same around the said first power lead to hold the same in a position where the contact-forming arms at the inner end thereof are forced against said backing means.

27. The cut-off link of claim 26 wherein a sealing cement covers and seals over adjacent surfaces of said closure means and said casing and first power lead, to hermetically seal the interior of the casing from the surrounding atmosphere.

28. The ambient thermal cut-off link of claim 26 wherein said contact-forming arm means forms an integral part of said first power lead so that the interface between said arm means and casing is the only separable contact interface between said power leads.

29. The cut-off link or switch of claims 1, 15, 16 or 26 wherein said fusible body is a body of fusible granular material compressed into one end of the casing so it expands and closely engages the exposed inner surfaces of the casing, to enable external heat to readily pass into said compressed body of fusible material.

30. The thermal switch or cut-off link of claims 2, 7, 18, 19 or 28 wherein said contact-forming arm means and said first power lead form a monolithic body formed from the same body of material.

* * * * *